United States Patent [19]

Smith et al.

[11] Patent Number: 4,854,761

[45] Date of Patent: Aug. 8, 1989

[54] NAIL POLISH REMOVER WAND CONTAINING DISPOSABLE PADS

[76] Inventors: Louise Smith, 805 E. Butler, Phoenix, Ariz. 85020; Frank W. Kautman, P.O. Box 47837, Phoenix, Ariz. 85068

[21] Appl. No.: 163,622

[22] Filed: Mar. 3, 1988

Related U.S. Application Data

[63] Continuation-in-part of Ser. No. 123,238, Nov. 20, 1987, abandoned.

[51] Int. Cl.[4] ..... A45D 29/17

[52] U.S. Cl. ..... 401/196; 401/57; 401/63; 132/73.5; 15/244.1; 221/267

[58] Field of Search ..... 401/57, 82, 196, 85, 401/89, 56, 63, 64, 86, 90, 261, 83, 84; 221/279, 250, 267, 280, 309, 310; 15/104.93, 244.1, 209 R, 210 R; 132/74.5, 73, 73.5, 75

[56] References Cited

U.S. PATENT DOCUMENTS

| | | | |
|---|---|---|---|
| 953,374 | 3/1910 | Clark . | |
| 1,236,878 | 8/1917 | Salvas . | |
| 1,451,941 | 4/1923 | Clum . | |
| 1,844,285 | 2/1932 | Johnson . | |
| 1,973,903 | 9/1934 | King | 401/83 |
| 2,219,754 | 10/1940 | Skold | 91/87.4 |
| 2,284,001 | 8/1942 | Ritter | 206/42 |
| 2,398,161 | 4/1946 | Skold | 15/244 |
| 2,431,121 | 11/1947 | Hunter | 221/279 |
| 2,598,325 | 5/1952 | Weekes | 312/46 |
| 2,698,682 | 1/1955 | Bodan | 206/1 |
| 2,760,302 | 8/1956 | Cheskin | 46/1 |
| 2,813,289 | 11/1957 | Even | 15/134 |
| 2,841,809 | 7/1958 | Oliver | 15/138 |
| 3,708,235 | 1/1973 | Kolomeir | 401/57 |
| 3,998,238 | 12/1976 | Nigro | 221/279 |
| 4,014,616 | 3/1977 | Mast, Jr. et al. | 401/292 |
| 4,521,127 | 6/1985 | Tomburo et al. | 401/68 |
| 4,699,161 | 10/1987 | Smith et al. | 132/73.5 |

FOREIGN PATENT DOCUMENTS

| | | | |
|---|---|---|---|
| 913133 | 8/1946 | France | 401/261 |
| 1062306 | 3/1967 | United Kingdom . | |

*Primary Examiner*—Richard J. Apley
*Assistant Examiner*—Franklin L. Gubernick
*Attorney, Agent, or Firm*—Warren F. B. Lindsley

[57] ABSTRACT

An improved nail polish removing wand comprising an elongated tubular device containing a stack of absorbent pads that are driven toward an open end of the tubular device by selective operator manipulation of the wand. The forward pad in the stack is moved to the end of the tubular device where it is held until ejected by a flange at the open end of the wand that cooperates with the geometric configuration of the pad. After the pad is used for removing nail polish, it is ejected by further manipulative action of the wand by the operator.

18 Claims, 3 Drawing Sheets

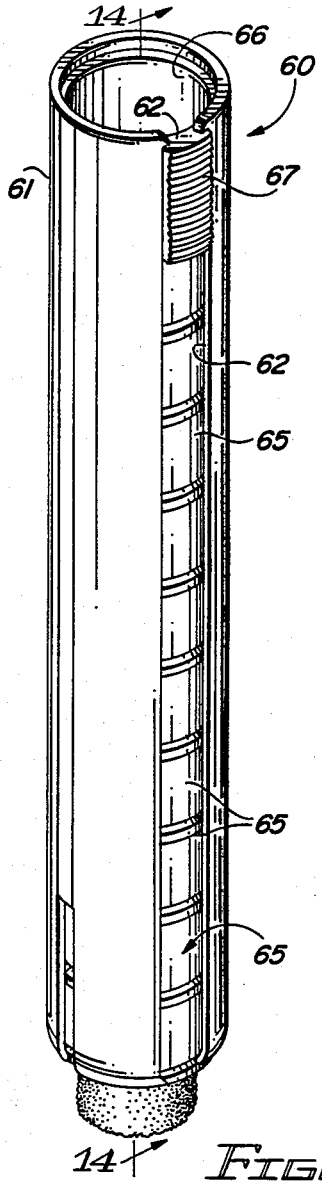
FIG. 13
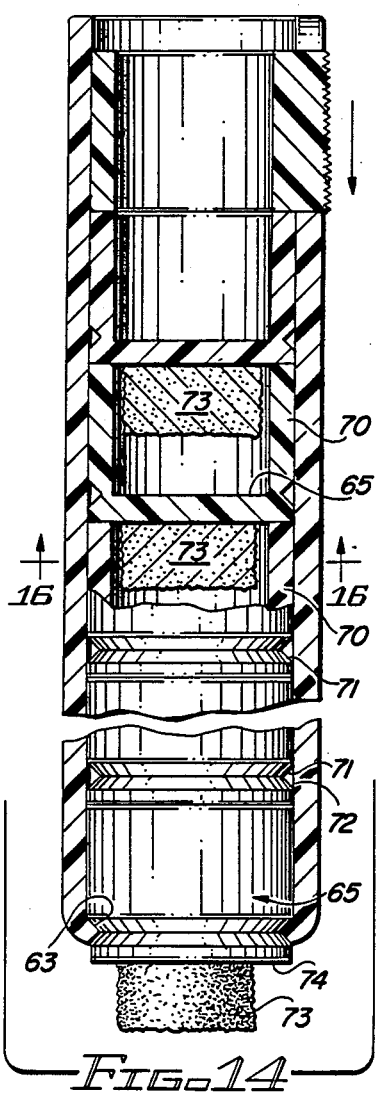
FIG. 14
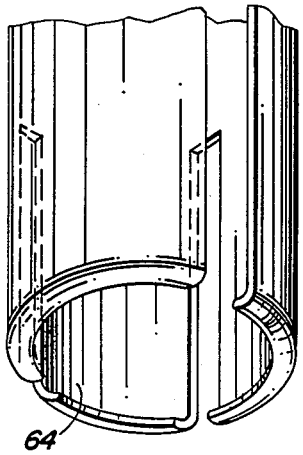
FIG. 15
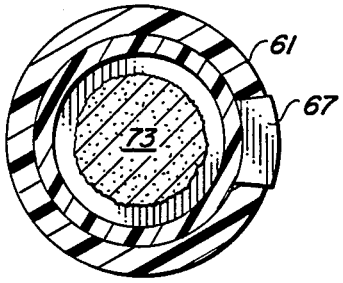
FIG. 16
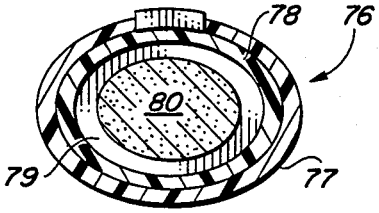
FIG. 18
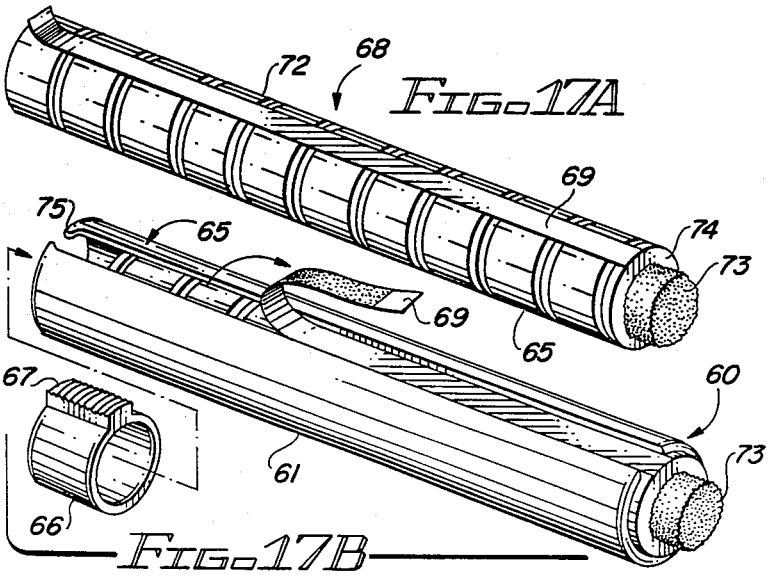
FIG. 17A
FIG. 17B
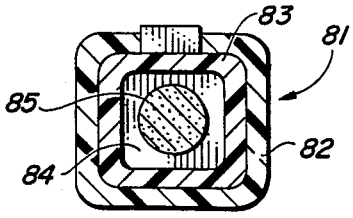
FIG. 19
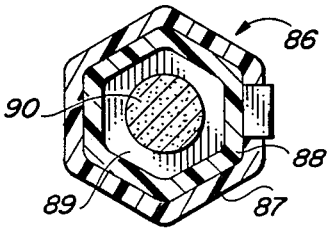
FIG. 20

NAIL POLISH REMOVER WAND CONTAINING DISPOSABLE PADS

BACKGROUND OF THE INVENTION

This application is a continuation in part of U.S. patent application Ser. No. 123,238 filed Nov. 20, 1987 and entitled NAIL POLISH REMOVER WAND CONTAINING DISPOSABLE PADS, and now abandoned.

One of the more awkward and inconvenient procedures involved in the care of the nails is the removal of the old polish. This is ordinarily accomplished with the use of cotton balls or sponge saturated in a special solvent commonly known as polish remover.

This method is especially undesirable for use by a manicurist. In the interest of promoting her own business and showing off to advantage her own skills and the aesthetic benefits of professional nail care, the typical manicurist likes to keep her own nails well polished and in superior condition. This is especially difficult if one must contend with the old method of removing polish from the client's nails. Because the saturated cotton balls inevitably come into contact with the nails of the manicurist, her own nail polish is very quickly smudged, marred or removed.

Further, there is a need for a simple wand containing disposable pads for individual home use.

Thus, a need exists for a device that will permit a more convenient and tidy procedure for professional and individual removal of nail polish.

DESCRIPTION OF THE PRIOR ART

U.S. Pat. No. 4,699,161 granted Oct. 13, 1987 to applicants is the closest prior art known. This application is directed to a modification of this patented structure.

The following U.S. Patents and British Patent cited during the prosecution of the application resulting in the allowance of U.S. Pat. No. 4,699,161 are considered pertinent but not anticipatory of this invention.

| U. S. Pat. Nos. | |
|---|---|
| 953,374 | 2,598,325 |
| 1,236,878 | 2,698,682 |
| 1,451,941 | 2,760,302 |
| 1,844,285 | 4,521,127 |
| 2,294,001 | |
| BRITISH PATENT | |
| 1,062,306 | |

The above identified patents disclose tubular containers which store and disperse various items which include stickers, toothbrushes, bearings and gears, but none disclose the holding and dispensing of pads for removing nail polish as claimed herein.

U.S. Pat. No. 2,813,289 discloses a nail cleaning device incorporating means for removing old polish and applying a new coat. The portion of the device that is intended for use in removing old polish comprises an elongated cylindrical tube containing a stack of compressed absorbent pads that are saturated with a solvent material. A piston at one end of the tube drives the pads toward the opposite open end when a shell surrounding the tube is rotated. The mechanism that drives the piston forward utilizes a helical groove engaged by a pin that extends laterally from the piston. In use, the pads are advanced until a fresh pad protrudes slightly from the open end. The tube with the protruding saturated pad is then employed to remove polish from one or more nails. After such use, the stack of pads is advanced again until the soiled pad is ejected and another fresh pad is moved into position for use.

In a variation of this device, the pads are housed in a dry condition and the solvent is applied at the time of use, either directly to the nail or to the protruding pad.

U.S. Pat. No. 2,841,809 discloses a fingernail polish removing tool comprising an elongated cylindrical tube that houses a stack of compressed absorbent pads. The pads are moved by means of a follower plate toward an open end of the tube. A thumb piece engages the follower plate through a longitudinal slot in the side of the tube. The protruding moistened pad is employed to clean one or more nails, and is then ejected by forward thumb pressure applied to the thumb piece.

U.S. Pat. No. 2,219,754 and 2,398,161 disclose lipstick spreaders comprising an elongated tubular container which is adapted to hold a series of lipstick spreading wads of porous latex rubber or like material.

SUMMARY OF THE INVENTION

In accordance with the invention claimed, an improved nail polish remover wand is provided comprising an elongated tubular device containing a stack of compressed absorbent pads that are driven toward an open end of the tubular device by selective operator manipulation of the wand. The forward pad in the stack is moved to the end of the open tube where its protruding end is employed to remove old polish from the nail. After such use, the pad is advanced further until it is ejected. A new cleaning pad is advanced into position for a subsequent cleaning operation during the ejection of the previously used pad.

It is, therefore, an object of the present invention to provide an improved wand type device for removing old polish from the nails.

Another object of this invention is to provide such a device in a form that is comfortable to hold in the hand and is readily controllable in use for its intended purpose.

A further object of this invention is to provide a device for holding an absorbent pad saturated with solvent so that the pad may be conveniently manipulated to remove polish from the nails of the user or another person while avoiding contact of the pad with the fingers of the hand holding the device.

A still further object of this invention is to provide such a device which may be inexpensively manufactured so that it may be thrown away when all of the applicators housed therein are used, or a new assembly of applicators may be inserted in the device for further use.

A still further object of this invention is to provide a new and novel assembly of absorbent applicators held together by a tear away adhesive strip, which strip is removed once the assembly has been inserted in the nail polish remover wand.

A still further object of this invention is to provide in such a device a mechanism which permits the convenient advancement and precise positioning of the absorbent pads at the tip of the device where their protruding ends may be sequentially employed in nail polish removal operations.

Yet another object of the invention is to provide such a device that is simple in form and construction, its individual parts being inexpensively molded from thermoplastic materials.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 13 is a still further modification of the nail polish remover wand shown in FIGS. 1–12;

FIG. 14 is a cross-sectional view of FIG. 13 taken along the line 14—14;

FIG. 15 is an enlarged perspective view of the dispensing end of the nail polish remover wand shown in FIG. 13 with the assembly of applicators removed;

FIG. 16 is a cross-sectional view of FIG. 14 taken along the line 16—16;

FIG. 17A is a perspective view of the assembly of applicators shown in FIGS. 13 and 14 with a tear away strip in place holding the various applicators together;

FIG. 17B is an exploded view of the assembly of applicators shown in FIG. 17A with the tear away strip partially removed;

FIG. 18 is a cross-sectional view of a modification of the nail polish remover wand shown in FIGS. 13–17 wherein the housing and assembly of applicators are of an oval configuration;

FIG. 19 is a cross-sectional view of a further modification of the nail polish remover wand shown in FIGS. 13–18 wherein the housing and assembly of applicators have a square cross-sectional configuration; and FIG. 20 is a cross-sectional view of a still further modification of the nail polish remover wand shown in FIGS. 13–19 wherein the housing and assembly of applicators have a hexagon configuration.

DESCRIPTION OF THE PREFERRED EMBODIMENT

Figure 1:
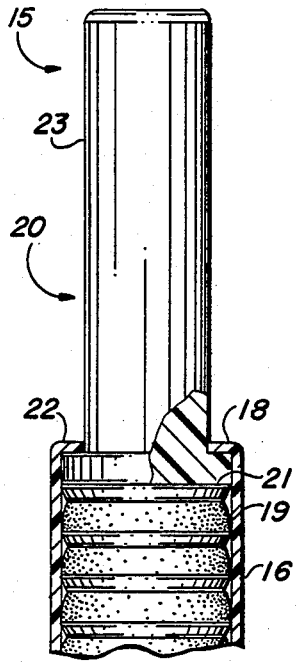
FIG. 1 is a view showing an improved nail polish remover wand embodying the invention broken away to show a plurality of compressed absorbent cleaning applicators housed therein.

Referring more particularly to the drawings by characters of reference, FIGS. 1–4 disclose a nail polish remover wand 15 embodying the invention and comprising a tubular cylindrical shell or housing 16 provided at one end with a first annular stop flange 17 and at its other end with a second annular stop flange 18. A plurality of applicators 19 are stacked within housing 16 for selective dispersal out of the housing, one at a time. The applicators are selectively moved out of the housing by a plunger 20, the head 21 of which is positioned within end 22 of housing 16 with its handle-like portion 23 extending axially outwardly of the housing.

If desired, the plunger may comprise a single integral part assembled by inserting the handle-like portion into and through end 22 of housing 16 prior to insertion of the applicators 19 into the housing. As an alternative, the plunger 20 may be threadedly connected to a threaded hole (not shown) in head 21 after the head is positioned in housing 16.

As noted, the annular stop flange 17 at the applicator dispensing end of housing 16 is so formed, that it tapers inwardly of the open end of the housing to form an opening the diameter of which is smaller than the diameter of housing 16. Flange 17 forming this opening is intended to coact with a narrow necked-down portion 24 of applicator 19, as shown in FIGS. 2 and 4 of the drawings, to firmly hold it in the applicator exposed position in the wand during use.

Figure 2:
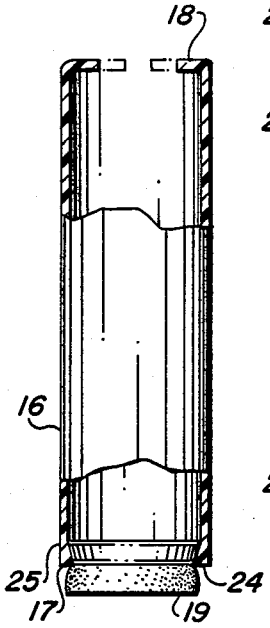
FIG. 2 is a cross-sectional view of the housing of the nail polish remover wand shown in FIG. 1.
Figure 4:
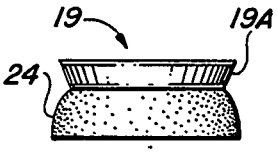
FIG. 4 is a perspective view of one of the applicators housed in the nail polish remover wand of FIGS. 1 and 2.

As shown in FIGS. 1, 2 and 4, applicator 19 comprises a rigid wedge-shaped portion 19A to which is adhesively secured an absorbent wedge-shaped sponge portion 19B, i.e., a compressed cotton pad.

Applicator 19 is intended to be used for nail polish removal when it is held in housing 16 in the position shown in FIG. 2. The rigid portion 19A of each applicator aids in firmly holding the applicator in operable nail polish removal position in the wand, and when the operator or user is through with the applicator, the handle 23 of the plunger is then pushed gently to dislodge the used applicator from the flange retaining position shown in FIG. 2 into a waste container, and simultaneously forcing a sequentially following applicator into the exposed firmly held position shown in FIG. 2.

Figure 3:
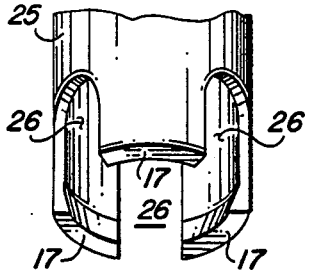
FIG. 3 is an enlarged perspective view showing the dispensing tip of the wand housing shown in FIGS. 1 and 2.

To aid in the controlled dispersal of the applicators from housing 16, the open dispensing end 25 of housing 16 may be formed around its periphery with a plurality of slots 26 extending axially of the housing, as shown in FIG. 3, to provide the walls of housing 16 with some resiliency so as to give slightly under the loading and dispensing of the applicators into and from housing 16.

Figure 5:
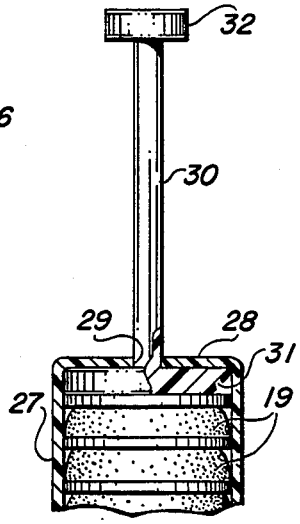
FIG. 5 is a partial view of a modification of the nail polish remover wand shown in FIGS. 1 and 2.

FIG. 5 illustrates a modification of the nail polish remover wand shown in FIGS. 1–4 wherein wand 26 comprises a housing 27 similar to housing 16, except that its end 28 is closed and is provided with an aperture 29 positioned axially thereof for receiving a push rod 30. Push rod 30 is an elongated rod secured at one end to a disc 31 and positioned in housing 27 to extend outwardly thereof to a knob-shaped end 32.

All of the other features of wand 26 are similar to wand 15, and function in a like manner.

Figure 6:
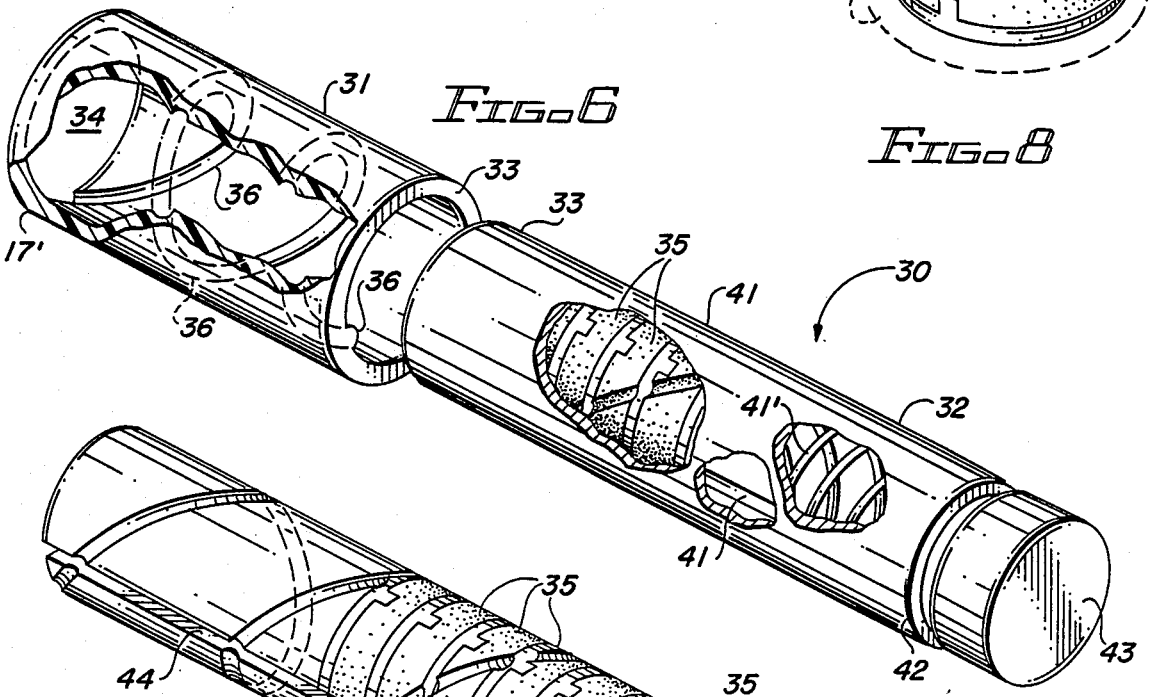
FIG. 6 is a perspective view of a further modification of the nail polish remover wand shown in FIGS. 1, 2 and 5.

FIG. 6 illustrates a further modification of the nail polish remover wands shown in FIGS. 1 and 5 wherein nail polish remover wand 30 comprises tubular portions 31 and 32 which are snap fitted together in a rotatable manner at 33 to form the wand-like structure shown.

This wand comprising the interconnected tubular parts 31 and 32 has an open end 34 which is provided with a stop flange 17' (similar to flange 17 of FIGS. 1–4) which is beveled to secure applicators 35 in the wand during use. The tubular part 31 is provided with a protruding steep thread 36 along its inner peripheral surface for guiding and moving the applicators from the cartridge storing portion of part 32 of the wand to the delivery end 34 of part 31 of the wand.

Figure 8:
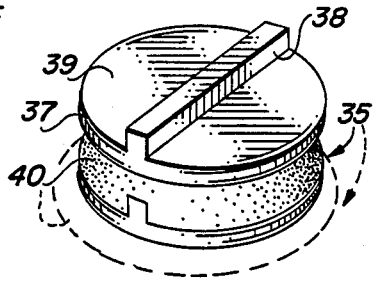
FIG. 8 is a perspective view of one of the applicators shown in FIGS. 6 and 7 showing in full lines the pad of the applicator in dry condition and in dash lines the size of the pad in its wet impregnated state.
Figure 7:
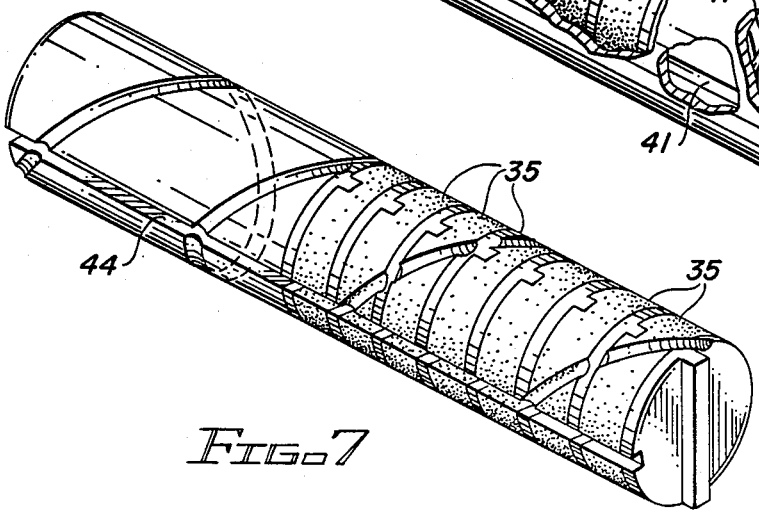
FIG. 7 is a perspective view of a stack of applicators assembled for insertion in the housing of the polish remover wand shown in FIG. 6.

As shown in FIGS. 7 and 8, the applicators 35 are arranged in a stack with each applicator comprising a plastic disc 37 having a rib 38 extending outwardly and laterally of a common surface 39 along a diameter thereof to form a handle for the user to grasp when the applicator is removed from the wand 30 and a sponge-like absorbent disc 40 secured to the surface 41 of disc 37 opposite to surface 39.

It should be noted that when the applicators 35 are assembled in a stack as shown in FIG. 7, and held together by a suitable adhesive or the like, if necessary, the ribs of the applicators within the stack assembly press into the sponge of the juxtapositioned applicator sufficiently to avoid the need to groove the adjacent sponge for receiving the rib and in turn lock the stack into a unitary structure so that it may rotate as a single unit.

As shown in FIG. 8, when sponge-like disc 37 is soaked in a nail polish remover solvent, the sponge may expand to assume a wet size similar to that shown by the dash lines in this Figure.

In order to feed the stack of applicators 35 shown in FIG. 7 through part 31 of wand 30 by means of the internal thread 36 in part 31, the outside surface of the assembly of applicators is provided with a steep spiral groove for mating with thread 36 in part 31 of wand 30.

To aid in feeding a stack of applicators 35 into and through part 32 of wand 30, part 32 is provided with one or more ribs 41 longitudinally and diagonally spaced along the inside periphery of part 32.

Thus, as the stack of applicators, shown in FIG. 7, are pushed into end 42 upon removal of cap 43 from part 32, one or more matching grooves 44 formed longitudinally along the length of the assembly will guide the assembly to and into part 31 of wand 30.

With the stack of applicators 35 pushed longitudinally into part 32 of wand 30 until the left most applicator, as shown in FIG. 6, enters part 31 of the wand, and the user then rotates part 32 relative to part 31, the left most applicator will be gripped by thread 36. Continued rotation of part 32 relative to part 31 in a common direction will break loose that applicator from the stack and threadedly move it along part 31, assuming that continued longitudinal pressure from the following applicators is applied to it.

Accordingly, cap 43 is provided with a compression spring 41' which bears on the assembly of applicators to provide a force on the stack of applicators for moving the applicators into and through part 31 of the wand.

Figure 10:
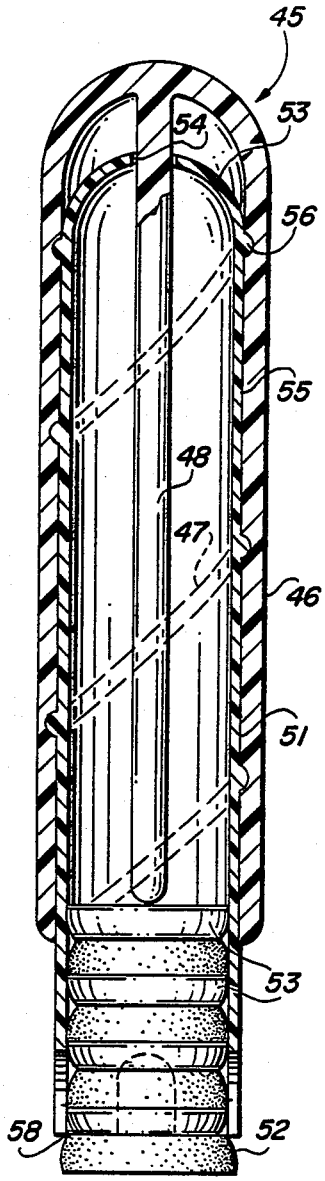
FIG. 10 is a perspective view of a still further modification of the nail polish remover wand shown in FIGS. 1, 5 and 6 comprising a disposable cartridge of applicators and a telescopically positioned outer rotating housing employing an applicator actuating prong.
Figure 9:
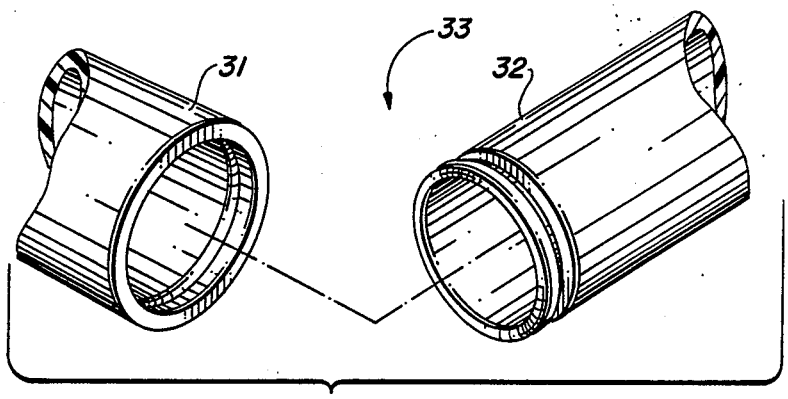
FIG. 9 is a partial perspective view illustrating the joining ends of the dispensing and applicator assembly storing ends of the wand shown in FIG. 6.
Figure 11:
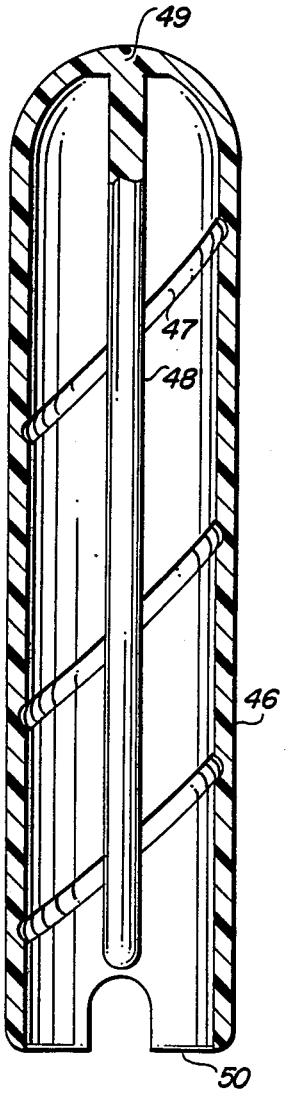
FIG. 11 is a perspective view of the housing shown in FIG. 1.
Figure 12:
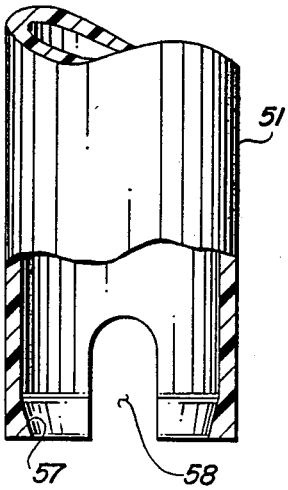
FIG. 12 is an enlarged cross-sectional view of the dispensing end of the disposable cartridge shown in FIG. 10.

FIGS. 10–12 disclose a further modification of the wands shown in FIGS. 1, 5 and 6 wherein wand 45 comprises an elongated hollow tubular housing 46, the interior peripheral surface of which is provided with a helical groove 47 extending longitudinally of the housing. A probe 48 extends inwardly of the closed end 49 of the housing along its length, as shown, toward its open end 50.

An elongated cartridge 51 containing an assembly of applicators 52 of the type shown in FIG. 4, is telescopically positioned for rotatable movement into the open end 50 of housing 46.

As noted, the capped end 53 of cartridge 51 is provided with an aperture 54 extending therethrough for receiving probe 48 of housing 46 when housing 46 is positioned around cartridge 51.

FIG. 10 illustrates that the outer periphery 55 of cartridge 51 is provided with a helical thread 56 which matches and/or mates with the helical groove 47 formed in the inside periphery of housing 46.

With cartridge 51 loaded with a stack of applicators 52 of the type identified as applicators 19 of FIGS. 1 and 4, housing 46 is then telescopically slipped over the capped end 53 of cartridge 51 with the probe 48 being inserted through aperture 54. Housing 46 is then rotated relative to cartridge 51 with the helical thread 56 on the outside periphery of cartridge 51, mating with groove 47 on the inside periphery of housing 46.

By rotating housing 46 around cartridge 51, probe 48 engages the top most applicator 52 in the cartridge forcing it partially out of cartridge 51 and into firm engagement with the internal flange 57, shown in FIGS. 10 and 12, formed around the periphery of the outlet 58 of cartridge 51.

Internal flange 57 engages an indentation in applicators 52 in the same manner as described above for necked-down portion 24. Rotation of housing 46 relative to cartridge 51 causes the movement of the housing over the cartridge in a telescopic manner, thereby causing probe 48 to force the stack of applicators selectively, one at a time, out of the open end 50 of housing 46 in the same manner as described above for the structure shown in FIGS. 1–5.

FIGS. 13–15 disclose a further modification of the nail polish remover wands shown in FIGS. 1–12 wherein nail polish remover wand 60 comprises an elongated cylindrical housing 61 having a slot 62 extending along its length and an annular stop flange 63 extending inwardly thereof provided at its open end 64 similar to flanges 17 and 57, shown in FIGS. 2 and 12, respectively. A plurality of applicators 65 similar to the type identified as applicators 19 in FIGS. 1–4 are stacked within housing 61 for selective dispersal out of the housing, one at a time in the manner heretofore described. The applicators are selectively moved out of the housing by an actuator 66 which selectively is moved by a user through finger pressure applied to a tab 67 of the actuator 66 extending through slot 62 of the housing 61.

The actuator 66 comprises a short cylinder slightly smaller in diameter than the inside diameter of housing 61, with its tab 67 extending outwardly of its outside periphery along at least a part of its length. This actuator which may be a hollow cylinder, as shown, or solid, if so desired, is slidably movable along the length of housing 61 to sequentially move the applicators 65 into holding engagement with flange 63 at the open end of the housing and then sequentially out of the housing in the manner heretofore explained.

As shown in FIG. 17A, the applicators are arranged in an elongated longitudinal interlocking cluster 68, held together by a tear away adhesive strip of material 69 which is removed once th cluster of applicators is mounted in housing 61 in the manner shown in FIG. 17B.

Each of the applicators 65 comprises a hollow cylindrical body 72 having a cap 71 closing one end thereof, which cap is provided with an indentation or groove 72 extending around its periphery. Groove 72 may be of a V-shaped configuration, extending inwardly of the cap substantially perpendicular to its longitudinal axis.

As noted from FIG. 14, each applicator comprises an absorbent pad 73 secured in a suitable manner, such as, for example, by gluing, to the exposed face 74 of cap 71. This pad, when assembled in the manner shown in FIG. 17A, fits into the hollow opening of the cylindrical body 69 of a juxtapositioned applicator in the cluster of applicators, as shown in FIG. 14. It should be noted that the hollow cylinders forming body 70 keep the pads clean in the cluster prior to use.

It should be noted that the nail polish remover wand 60 shown in FIGS. 13–17B may comprise a throw away structure that is used when all of the applicators 65 are dispersed therefrom, since it may be economically manufactured. However, since its housing 61 may be formed of a suitable plastic, it may be reused many times by inserting therein a cluster 68 of applicators 65, as shown in FIG. 17A. This cluster may be economically assembled in the longitudinal array shown by holding them together in an interlocking array by a simple tear away adhesive strip 69 of a suitable paper or plastic material.

To assemble the cluster in housing 61 of wand 60, the actuator 66 may be removed from either end of the housing by merely forcing it past the flange 63 at its dispensing end or past the beaded end 75 at the other end of the housing of wand 60.

Although the nail polish remover wands shown in FIGS. 13–16 are of a circular cross-sectional configuration, it should be noted that they may comprise other geometrical configurations and still fall within the scope of this invention.

FIG. 18 illustrates that a nail polish remover wand 76 may comprise an oblong housing 77 and actuator 78 having oblong applicators 79 and oblong pads 80 arranged therein.

FIG. 19 illustrates that a nail polish remover wand 81 may comprise a housing 82, actuator 83, applicator 84 and pads 85, all of a substantially square cross-sectional configuration.

FIG. 20 illustrates that a nail polish remover wand 86 may comprise a housing 87, actuator 88, applicator 89 and pads 90, all of a hexagon configuration and still fall within the scope of this invention.

Although but a few embodiments of the present invention have been illustrated and described, it will be apparent to those skilled in the art that various changes and modifications may be made therein without departing from the spirit of the invention or from the scope of the appended claims.

What is claimed is:

1. A nail polish removing wand comprising:

a hollow elongated housing open at opposite ends thereof, an assembly of individual applicators mounted in said housing along its length in a common direction, each applicator comprising a substantially first part secured, to a second part comprising an absorbent pad which can be saturated with a nail polish solvent, a pressure applying actuator means mounted within one end of said housing for urging the movement of said applicators out of the other end of said housing, and flange means forming at least a part of the periphery of said other end of said housing for restricting the movement of said applicators out of said housing, said applicators each being provided with an indentation at a common point along its length for engaging with said flange means for holding each applicator as it passes through said other end of said housing in a position partially outside of said housing until said actuator means is again sequentially actuated by a user to force a juxtapositioned applicator into flange holding position in said other end of said housing and simultaneously dislodging from said wand the previously held actuator said applicators are arranged whereby when the housing flange means engages an applicator indentation, the absorbent pad of the applicator extends beyond the housing and is held in place allowing the pad to be rubbed on a nail with the housing acting as a handle.

2. The nail polish removing wand set forth in claim 1 wherein:

said housing, said actuator means and said applicators all comprise cylindrical configurations.

3. The nail polish removing wand set forth in claim 1 wherein:

said housing, said actuator means and said applicators all comprise an oblong geometrical configuration.

4. The nail polish removing wand set forth in claim 1 wherein:

said housing, said actuator means and said applicators all comprise rectangular geometrical configurations.

5. The nail polish removing wand set forth in claim 1 wherein:

said housing, said actuator means and said applicators all comprise hexagonal geometrical configurations.

6. The nail polish removing wand set forth in claim 1 wherein:

said indentation comprises a groove extending around the periphery of said applicators substantially perpendicular to its longitudinal axis.

7. The nail polish removing wand set forth in claim 1 wherein:

the absorbent pads of each of the applicators inside of said housing protrude into the hollow interior of said first part of a juxtapositioned applicator.

8. The nail polish removing wand set forth in claim 2 wherein:

said absorbent pad of each applicator has a cylindrical configuration of a smaller diameter than the diameter of the associated first part.

9. The nail polish removing wand set forth in claim 1 wherein:

said housing is provided with a slot extending therethrough longitudinally thereof, and said actuator means comprising a tab extending outwardly through said slot for engagement by a user for moving said applicators along the length of said housing.

10. The nail polish removing wand set forth in claim 1 wherein:

said actuator means comprises a probe mounted to extend within said one end of said housing for selectively moving axially into engagement with said applicators for moving said applicators relative to said housing.

11. The nail polish removing wand set forth in claim 1 wherein:

said actuator means comprises a helical thread formed axially along the hollow interior of said housing, and a mating helical groove formed in the outer periphery of said axially arranged applicators, said applicators being moved through said housing upon relative movement of said housing and said actuator means.

12. The nail polish removing wand set forth in claim 1 wherein:

said other end of said housing is slotted inwardly along its length for aiding in flexing said other end of the housing when said applicators are forced therein.

13. The nail polish removing wand set forth in claim 1 wherein:

said other end of said housing is spacedly slotted inwardly of its end and longitudinally of said housing for aiding in flexing said other end of the housing when said applicators are forced therethrough.

14. The nail polish removing wand set forth in claim 1 wherein:

said first part of said applicators is provided with a ridge extending laterally and outwardly thereof along a diameter of said first part for interlocking with juxtapositioned applicators in said assembly.

15. The nail polish removing wand set forth in claim 1 wherein:

said indentation is formed in said first part of each applicator.

16. A nail polish removing wand comprising:

first and second hollow cylindrical interconnectable axially aligned selectively rotatable parts open when interconnected at opposite ends thereof, said first part comprising a housing for receiving and storing until used an assembly of cylindrically shaped axially aligned and axially positioned absorbent pad means, and the second of said parts comprising a holding and dispensing means for said pad means, each pad means having a substantially rigid first part and an attached absorbent second part, which can be saturated with a nail polish solvent;

pressure applying means mounted at least partially within one end of said first part for urging the movement of said pad means out of said first part and into the second of said parts, and flange means forming at least a part of the periphery of an outer end of said second part for restricting the movement of said pad means out of the wand, said pad means each being provided with a groove at a common point along its length for engaging with said flange means for holding each pad means as it passes through said outer end of said second first in a position exposing the second part of said pad means outside of said wand until said pressure applying means is selectively actuated to force a juxtapositioned pad means into a position in said outer end of said second part for holding by said flange means and simultaneously dislodging from the wand the previously held pad means and whereby the first and second parts can act as a handle for operatively using the device.

17. The nail polish removing wand set forth in claim 16 wherein:

said pressure applying means comprises a helical thread formed axially along the hollow interior of said second part, said assembly of pad means is provided with a mating helical groove formed in the outer periphery of said assembly, and spring means mounted in said first part for urging said assembly into the second of said parts, whereby rotation of one of said parts by the user relative to the second of said parts causes one of said pad means to be at least partially exposed out of the outer end and upon further rotation of one of said parts causing the exposed pad means to be discharged from the wand and a sequentially positioned pad means in said assembly to be positioned by said flange in an exposed position.

18. The nail polish removing wand set forth in claim 16 wherein:

said outer end of said second part is slotted inwardly longitudinally of the outer end for aiding in flexing said outer end of the wand when said pad means are forced therethrough.

* * * * *

UNITED STATES PATENT AND TRADEMARK OFFICE

CERTIFICATE OF CORRECTION

PATENT NO. : 4,854,761

DATED : August 8, 1989

INVENTOR(S) : Louise Smith et al

It is certified that error appears in the above-identified patent and that said Letters Patent is hereby corrected as shown below:

Claim 1, line 6, after "substantially" insert --rigid--.

line 7, after "secured" delete ",".

line 26, after "actuator" add --,--.

Claim 12, line 6, delete "therein." and substitute --therethrough.--.

Claim 16, line 24, after "second" delete "first" and substitute --part--.

Signed and Sealed this

Nineteenth Day of June, 1990

*Attest:*

*Attesting Officer*

HARRY F. MANBECK, JR.

*Commissioner of Patents and Trademarks*